US010058902B1

(12) United States Patent
Montalbano

(10) Patent No.: US 10,058,902 B1
(45) Date of Patent: Aug. 28, 2018

(54) BUCKET CLEANING APPARATUS AND METHOD OF USE THEREOF

(71) Applicant: Chris J. Montalbano, Elk Grove Village, IL (US)

(72) Inventor: Chris J. Montalbano, Elk Grove Village, IL (US)

( * ) Notice: Subject to any disclaimer, the term of this patent is extended or adjusted under 35 U.S.C. 154(b) by 0 days.

(21) Appl. No.: 15/900,423

(22) Filed: Feb. 20, 2018

Related U.S. Application Data

(63) Continuation-in-part of application No. 14/540,735, filed on Nov. 13, 2014.

(60) Provisional application No. 61/907,030, filed on Nov. 21, 2013.

(51) Int. Cl.
*B08B 9/38* (2006.01)
*B08B 9/08* (2006.01)
*B08B 9/043* (2006.01)

(52) U.S. Cl.
CPC ..... *B08B 9/0804* (2013.01); *B08B 9/0436* (2013.01); *B08B 9/0808* (2013.01)

(58) Field of Classification Search
CPC ... A47L 17/06; B01F 7/00208; B08B 9/0804; B08B 9/0808
See application file for complete search history.

(56) References Cited

U.S. PATENT DOCUMENTS

| | | | |
|---|---|---|---|
| 1,366,777 | A | 1/1921 | Flowers |
| 2,027,756 | A | 1/1936 | Tay |
| 5,732,434 | A | 3/1998 | McCarty |
| 2010/0288989 | A1 | 11/2010 | Williams et al. |
| 2013/0168878 | A1 | 7/2013 | Longhi et al. |

OTHER PUBLICATIONS

Montalbano, Chris J., Bucket Cleaning Apparatus and Method of Use Thereof, Patent Cooperation Treaty Application Serial No. PCT/US14/66853, filed Nov. 21, 2014, International Search Report and Written Opinion dated Feb. 9, 2015.

*Primary Examiner* — Mikhail Kornakov
*Assistant Examiner* — Ryan L. Coleman
(74) *Attorney, Agent, or Firm* — Schmeiser, Olsen & Watts, LLP

(57) ABSTRACT

A bucket cleaning apparatus is provided. The bucket cleaning apparatus includes a frame. One or more primary support members is coupled individually to the frame. A corresponding secondary support member is coupled to each primary support member. A scraper is coupled to one or more of each of the primary support members and secondary support members, wherein each scraper is adjustable with respect to the primary support member or secondary support member to which the scraper is coupled. A bucket may be inserted over the top of the primary support members such that the scrapers on at least the primary support members engage interior surfaces of the bucket to clean out the bucket as the bucket is rotated about the primary support members.

6 Claims, 12 Drawing Sheets

BUCKET CLEANING APPARATUS AND METHOD OF USE THEREOF

CROSS REFERENCE TO RELATED APPLICATION[S]

This application is a continuation-in-part of earlier filed U.S. Patent Application entitled "BUCKET CLEANING APPARATUS AND METHOD OF USE THEREOF," Ser. No. 14/540,735, filed Nov. 13, 2014, which claims priority to U.S. Provisional Patent Application entitled "BUCKET CLEANING APPARATUS AND METHOD OF USE THEREOF," Ser. No. 61/907,030, filed Nov. 21, 2013, the disclosures of which are hereby incorporated entirely herein by reference.

BACKGROUND

Technical Field

This disclosure relates generally to a cleaning device and in particular to an apparatus for cleaning buckets.

State of the Art

A bucket, or pail, is typically a watertight, vertical cylinder or truncated cone, with an open top and a flat bottom, usually attached to a semicircular carrying handle. Buckets have traditionally been used to hold, carry, transport, and/or store raw materials, wet goods, dry goods, building materials, sand, dirt, and too many other numerous items to name.

Buckets come in all shapes, sizes, and materials. But in recent decades, plastic buckets have become popular due to their lower relative weight, durability and compatibility with the food products. Because of their many advantageous properties, plastic buckets are often reused over and over again in one application after another.

Yet, regardless of the material the bucket is made out of, if the bucket is to be reused, or in some cases properly discarded, it must first be adequately cleansed of the materials it previously contained. In many cases, and in particular in instances where liquids or wet goods are housed or contained within the bucket, the liquid or wet goods may tend to stick to the interior of the bucket. Under these conditions, it may be necessary to physically clear out, or clean out, the remaining portions of the liquids or wet goods from the interior surfaces of the bucket. Avoiding excessive waste of the product and adhering to or satisfying environmental regulations/restrictions/concerns are two of many reasons why this may be desirable.

However, it may be cumbersome, costly, and inefficient to clean out the interior of each bucket. Indeed, the interior of the bucket may be somewhat difficult to access, depending on the size and shape of the bucket. Moreover, the effort to clean out the interior of the bucket may be more burdensome than the benefit the labor provides. Those that are hired to clean out the buckets may develop fatigue or other injury from repetitive motion and physical exertion.

Therefore, it would be advantageous for any industry that utilizes buckets in any way to store, transport, mix, carry, deliver, and/or otherwise handle liquids and wet goods to have access to an apparatus and method of use thereof that addresses the difficulty in cleaning out buckets after their use.

SUMMARY

The present disclosure relates generally to a cleaning device and in particular to an apparatus for cleaning buckets.

An aspect of the present disclosure includes a bucket cleaning apparatus comprising a frame, a primary support member coupled to the frame, a secondary support member coupled to the primary support member, a scraper coupled to the primary support member, wherein the scraper is adjustable with respect to the primary support member, and a scraper coupled to the secondary support member, wherein the scraper is adjustable with respect to the secondary support member.

Another aspect of the present disclosure includes a bucket cleaning apparatus comprising a frame, a plurality of primary support members coupled individually to the frame, a plurality of secondary support members, each secondary support member being coupled to a corresponding primary support member, a scraper coupled to each of the primary support members, wherein each scraper is adjustable with respect to the primary support member to which the scraper is coupled, and a scraper coupled to each of the secondary support members, wherein each scraper is adjustable with respect to the secondary support member to which the scraper is coupled.

Another aspect of the present disclosure includes the frame being comprised of one or more frame members coupled together to form a box-like frame that can be attached to an object. One or more primary support members is coupled individually to the frame, such that the primary support member protrudes obliquely or orthogonally from the frame. A corresponding secondary support member is coupled to each primary support member, such that the secondary support member protrudes obliquely or orthogonally from the primary support member. If the apparatus includes more than one primary support member, and therefore more than one secondary support member, the secondary support members may couple to one another at a junction. A scraper is coupled to one or more of each of the primary support members and secondary support members, wherein each scraper is adjustable with respect to the primary support member or secondary support member to which the scraper is coupled and wherein an edge of the scraper extends from an edge of each of the primary support members and secondary support members. A bucket may be inserted over the top of the primary support members such that the scrapers on at least the primary support members engage interior surfaces of the bucket to clean out the bucket as the bucket is rotated about the primary support members. Further, scrapers on the secondary support members can engage interior bottom surfaces of the bucket to clean out the bucket as the bucket is rotated about the primary support members.

Another embodiment includes a method of using a bucket cleaning apparatus. The method comprises removably coupling a primary scraper to each of a plurality of primary support members coupled individually to a frame; removably coupling secondary scraper to each of a plurality of secondary support members, each secondary support member being coupled to a corresponding primary support member of the plurality of primary support members; placing a bucket with material on the interior sides and bottom over the apparatus wherein the primary scrapers engage the interior sides and the secondary scrapers engage the interior bottom of the bucket; and scraping the material from the interior side and bottom of the bucket in response to rotating the bucket while over the apparatus.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
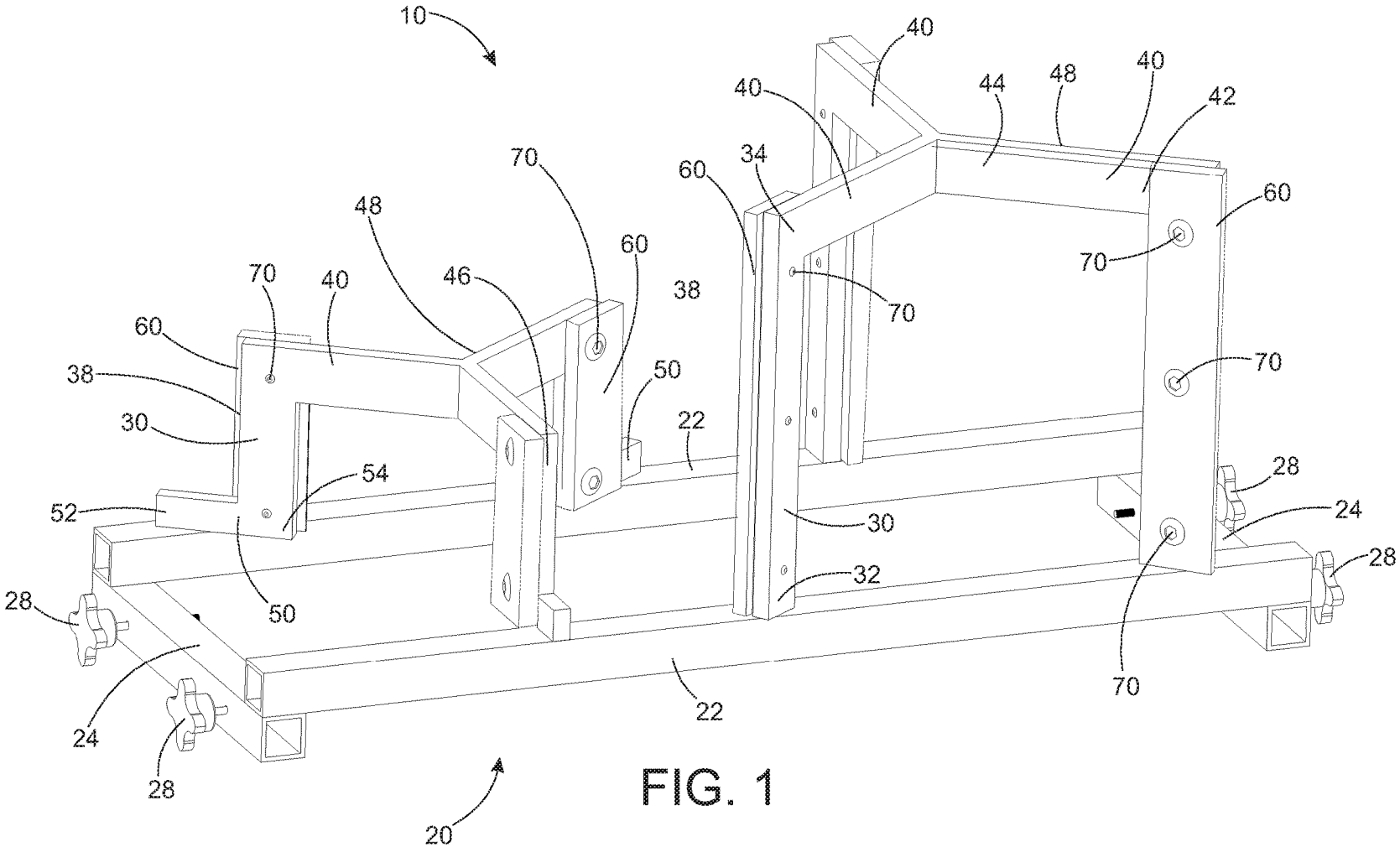
FIG. 1 is a front perspective view of an embodiment of a bucket cleaning apparatus in accordance with the present disclosure.
Figure 3:
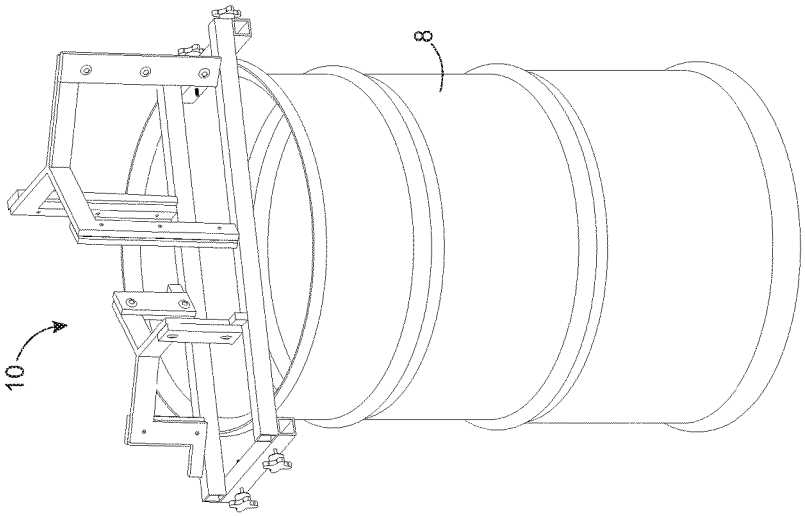
FIG. 3 is a front perspective view of an embodiment of a bucket cleaning apparatus coupled to an object in accordance with the present disclosure.
Figure 2A:
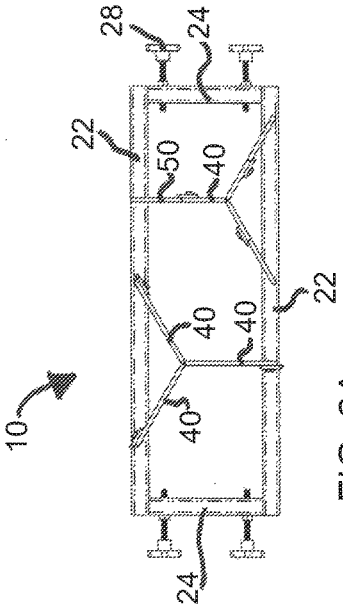
FIG. 2A is a top view of an embodiment of a bucket cleaning apparatus in accordance with the present disclosure.
Figure 2B:
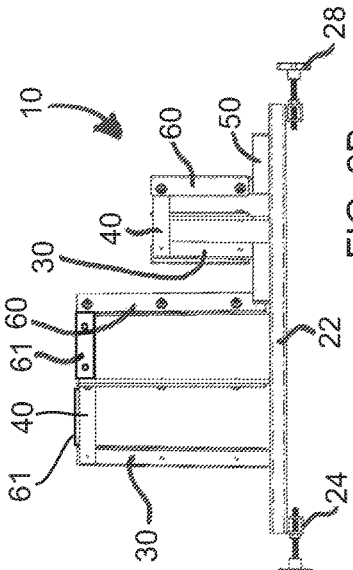
FIG. 2B is a side view of the embodiment of the bucket cleaning apparatus depicted in FIG. 2A, in accordance with the present disclosure.
Figure 2C:
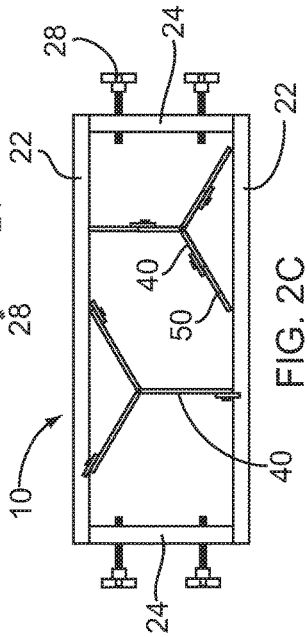
FIG. 2C is a bottom view of the embodiment of the bucket cleaning apparatus depicted in FIG. 2A, in accordance with the present disclosure.

Referring to the drawings, FIG. 1 depicts a bucket cleaning apparatus 10. Embodiments of the apparatus 10 may comprise various structural components that complement one another to provide the unique functionality and performance of the apparatus 10, the structure and function of which will be described in greater detail herein. Embodiments of the apparatus 10 may comprise, among other components, a frame 20, a primary support member 30, a secondary support member 40, a positioning member 50, and a primary scraper 60 and a secondary scraper 61.

Embodiments of the apparatus 10 may further comprise a frame 20. The frame 20 may comprise a frame member 22. The frame member 22 may be any structure, component, part, or piece that supports the additional components of the apparatus 10 thereon. The frame member 22 may assume any shape and size that is convenient to set thereon the additional components of the apparatus 10. As depicted, the frame 20 may comprise one or more frame members 22, and these frame members 22 may be oriented with respect to one another substantially in parallel and oppose one another along their respective lengths. The frame 20 may comprise secondary frame members 24 that may be in an orientation that is substantially orthogonal to the frame members 22, such that under the condition the secondary frame members 24 are coupled to the distal ends of each of the frame members 22, the length of the secondary frame members 24 spaces apart the frame members 22 from one another. As depicted, the configuration of the frame members 22 and the secondary frame members 24 comprise a rectangular, or box-like, frame, with the frame members 22 and the secondary frame members 24 coupled thereto at respective distal ends. As depicted, the frame members 22 may be fixedly coupled to the secondary frame members 24 to form a box-like shape for the frame 20.

Moreover, the frame members 22 and/or secondary frame members 24 may comprise adjustable couplers 28 thereon. These adjustable couplers 28 may allow the frame 20 to releasably and repeatedly couple to another object 8, such as, for example and not in any limiting way, a 55-gallon drum or a five-gallon bucket, as the case may be. These adjustable couplers 28 may reside in one or more of the frame members 22 or secondary frame members 24. Each of the adjustable couplers 28 may be adjustable on its respective frame member 22 or secondary frame member 24 to which it is operatively coupled. The adjustable couplers 28 may be coupled on the frame 20 to oppose one another, such that as the adjustable couplers 28 are adjusted with respect to the object 8, the forces exerted on the object 8 may oppose one another to secure the apparatus 10 on or over the object 8, as needed. As depicted, the adjustable couplers may be bolts that transition in or out of one of the frame members 22 or secondary frame members 24. As depicted, the secondary frame members 24 may have the adjustable couplers 28 therein and the adjustable couplers 28 may be utilized to couple the secondary frame members 24 to the object 8.

Embodiments of the apparatus 10 may further comprise a primary support member 30. The primary support member 30 may be a material having a length defined between a first end 32 and a second end 34. The length of the primary support member 30 may be fixed. The length of the primary support member 30 may be adjustable. The length of the primary support member 30 may be adjustable on itself. In other words, the primary support member 30 may be comprised of one or more parts that are adjustable with respect to one another to adjust the overall length of the primary support member 30. The primary support member 30 may be comprised of rigid materials, such as rigid polymers, plastics, metals, and other like materials that may provide the structure and function of the primary support member 30 herein described. The primary support member 30 may be coupled to the frame 20. The primary support member 30 may be oriented with respect to the frame 20 so as to project from the frame 20. The primary support member 30 may extend orthogonally from the frame 20, such that the primary support member 30 may be oriented substantially vertically with respect to the horizontally-oriented frame member 22. The first end 32 of the primary support member 30 may be coupled to the frame 20. The first end 32 may be releasably coupled to the frame 20. The first end 32 may be adjustable along the length of the frame 20, so as to be repositioned along the frame 20 at any point, if needed. Alternatively, the first end 32 may be fixedly coupled to the frame 20. The first end 32 may be coupled to a side surface of the frame member 22. The first end 32 may alternatively be coupled to a top surface of the frame member 22.

The primary support members 30 may be coupled on the frame 20 such that the primary support members 30 may contact the interior surfaces of the bucket to scrape out residual material from the interior surfaces of the bucket as the bucket is rotated, or otherwise spun, about the primary support members 30 with respect to the frame 20. The primary support members 30 may operate to scrape off the material from the interior side surfaces of the bucket.

The primary support member 30 may define openings 36 therein along its length. The openings 36 are not visible in the Figures because of the fasteners 70 inserted therein. The openings 36 may be located at predetermined positions along the length of the primary support member 30. The openings 36 may have a shape and size so as to allow a fastener 70 to couple a primary scraper 60 to the primary support member 30 with the primary scraper 60 in more than one orientation with respect to the primary support member 30. Each of the openings 36 may comprise a specific shape and size depending on its relative position along the length of the primary support member 30. For example, the opening 36 may be oblong in shape or oval in shape to allow the fastener to couple the primary scraper 60 to the primary support member 30 in a variety of adjustable positions. The openings 36 may allow a portion of the primary scraper 60 to extend off of an edge portion 38 of the primary support member 30, so as to protrude beyond the edge portion 38.

As depicted in the Figures, embodiments of the apparatus 10 may further comprise one or more primary support members 30 being coupled to the frame members 22 in a configuration to allow a bucket to be tipped upside down and placed over the primary support members 30 such that each of the primary support members 30 enter the interior of the bucket. The primary support members 30 may be coupled on the frame 20 such that the primary scrapers 60 positioned on each of the primary support members 30 and extending from the edge portion 38 may contact the interior surfaces of the bucket to scrape out residual material from the interior surfaces of the bucket as the bucket is rotated, or otherwise spun, about the primary support members 30 with respect to the frame 20. The primary scrapers 60 on the primary support members 30 may be operate to scrape off the material from the interior side surfaces of the bucket.

Embodiments of the apparatus 10 may further comprise a secondary support member 40. The secondary support member 40 may be a material having a length defined between a first end 42 and a second end 44. The length of the secondary support member 40 may be fixed. The length of the secondary support member 40 may be adjustable. The length of the secondary support member 40 may be adjustable on itself. In other words, the secondary support member 40 may be comprised of one or more parts that are adjustable with respect to one another to adjust the overall length of the secondary support member 40. The secondary support member 40 may be comprised of rigid materials, such as rigid polymers, plastics, metals, and other like materials that may provide the structure and function of the secondary support member 40 herein described. The secondary support member 40 may be coupled to the primary support member 30. The secondary support member 40 may be oriented with respect to the primary support member 30 so as to project from the primary support member 30. The secondary support member 40 may extend orthogonally from the primary support member 30, such that the secondary support member 40 may be oriented substantially horizontally with respect to the vertically-oriented primary support member 30. The first end 42 of the secondary support member 40 may be coupled to the primary support member 30. The first end 42 may be releasably coupled to the primary support member 30. The first end 42 of the secondary support member 40 may be coupled to the second end 34 of the primary support member 30.

Each of the secondary support members 40 may be coupled to the primary support member 30 such that secondary support members 40 may contact the interior of the bucket to scrape out residual material from the interior surfaces of the bucket as the bucket is rotated, or otherwise spun, about the primary support members 30 with respect to the frame 20. The secondary support members 40 may operate to scrape off the material from the interior bottom surfaces of the bucket. Under the condition that a secondary support member 40 is coupled to each of the primary support members 30, the second end 34 of each of the secondary support members 40 may be coupled together at a junction 45 for structural support and rigidity. The respective second ends 34 of each of the secondary support members 40 may be fixedly coupled together at the junction 45. The secondary support members 40 may extend substantially perpendicular from the primary support members 30 and extend to the junction 45. The secondary support members 30 may be substantially equal in length. In at least this way, the edge of the secondary support members 40 radially extend from the junction 45 in order to engage the primary scraper extending off of edge portions 48 of the primary support members 40 with an interior side of a bucket. Accordingly, in operation, all of the primary scrapers and secondary scrapers engage the interior surfaces of a bucket to scrape and remove material from within the bucket.

The secondary support member 40 may define openings 46 therein (not depicted) along its length. The openings 46 may be located at predetermined positions along the length of the secondary support member 40. The openings 46 may have a shape and size so as to allow a fastener 70 to couple a secondary scraper 61 to the secondary support member 40 with the secondary scraper 61 in more than one orientation with respect to the secondary support member 40. Each of the openings 46 may comprise a specific shape and size depending on its relative position along the length of the secondary support member 40. For example, the opening 46 may be oblong in shape or oval in shape to allow the fastener 70 to couple the secondary scraper 61 to the secondary support member 40 in a variety of adjustable positions. The openings 46 may allow a portion of the secondary scraper 61 to extend off of an edge portion 48 of the secondary support member 40, so as to protrude beyond the edge portion 48.

As depicted in the Figures, embodiments of the apparatus 10 may further comprise one or more secondary support members 40. Each of the secondary support members 40 may be coupled to a respective primary support member 30. Each of the secondary support members 40 may be coupled to the primary support member 30 such that the secondary scrapers 61 positioned on each of the secondary support members 40 and extending from the edge portion 48 may contact the interior of the bucket to scrape out residual material from the interior surfaces of the bucket as the bucket is rotated, or otherwise spun, about the primary support members 30 with respect to the frame 20. The secondary scrapers 61 on the secondary support members 40 may operate to scrape off the material from the interior bottom surfaces of the bucket. Under the condition that a secondary support member 40 is coupled to each of the primary support members 30, the second end 34 of each of the secondary support members 40 may be coupled together at a junction 45 for structural support and rigidity. The respective second ends 34 of each of the secondary support members 40 may be fixedly coupled together at the junction 45.

As depicted in the Figures, embodiments of the apparatus 10 may further comprise a positional member 50. The positional member 50 may be a material having a length defined between a first end 52 and a second end 54. The length of the positional member 50 may be fixed. The length of the positional member 50 may be adjustable. The length of the positional member 50 may be adjustable on itself. In other words, the positional member 50 may be comprised of one or more parts that are adjustable with respect to one another to adjust the overall length of the positional member 50. The positional member 50 may be comprised of rigid materials, such as rigid polymers, plastics, metals, and other like materials that may provide the structure and function of the positional member 50 herein described. The positional member 50 may be coupled between the frame 20 and the primary support member 30. The positional member 50 may be coupled to the frame 20 at the first end 52 and coupled to the primary support member 30 at the second end 54. The positional member 50 may be oriented with respect to the frame 20, and in particular the frame member 22, so as to project inwardly into the interior of the frame 20. The positional member 50 may extend from one frame member 22 and inwardly toward an opposing frame member 22, such that the positional member 50 may be within the interior of the frame 20. The positional member 50 may be oriented substantially horizontally with respect to the vertically-oriented primary support member 30. The first end 52 of the positional member 50 may be coupled to the frame 20 and the second end 54 of the positional member 50 may be coupled to the first end 32 of the primary support member 30. The first end 52 may be releasably coupled to the frame 20. The second end 54 may be releasably coupled to the primary support member 30.

As depicted in the Figures, embodiments of the apparatus 10 may further comprise one or more positional members 50. Each of the positional members 50 may be coupled between a respective portion of the frame 20 and a respective primary support member 30. The positional members 50 may permit a set of primary support members 30 to be inset from the frame 20 to be positioned closer with respect to one another to engage a bucket of smaller diameter than that of the width between opposing frame members 22.

As depicted in FIG. 1, the frame 20 may support thereon a plurality of sets of primary support members 30. A set of primary support members 30 may comprise three primary support members 30 that work together. A first set of primary support members 30 may comprise three primary support members 30 coupled on the frame 20 at a distance from one another to be able to concurrently engage the interior surfaces of a bucket that is placed thereover. For example, two primary support members 30 may be positioned on a first frame member 22 a distance from one another that is equal to a distance between each of the first and second primary support members 30 on the first frame member 22 and a third primary support member 30 that is positioned on an opposing frame member 22. As such, the distance between each of the three primary support members 30 in the set of primary support members 30 is equidistant, such that the set of primary support members 30 may concurrently engage a bucket having a uniform diameter that is placed thereover.

A second set of primary support members 30 may be coupled on the frame 20 right next to the first set. The second set of three primary support members 30 may comprise three primary support members 30 coupled on corresponding positional members 50, such that the three primary support members 30 are set within the frame members 22 and are yet positioned at a distance from one another to be able to concurrently engage the interior surfaces of a bucket that is placed thereover. For example, three positional members 50 may extend from the opposing frame members 22. The corresponding three primary support members 30 may extend vertically from the corresponding positional members 50. In this way, the distance between the three primary support members 30 is smaller than the distance between the three primary support members 30 of the first set of primary support members 30. As such, the three primary support members 30 in the second set of primary support members 30 can engage a bucket of smaller diameter than that of the first set of primary support members 30. In other words, in this configuration, the apparatus 10 may engage buckets of at least two different diameters. In embodiments of the apparatus 10 where the primary support members 30 may be adjusted on the frame members 22, or the positional members 50 may be adjusted on themselves for length, the apparatus 10 may be adjustable and configurable to engage buckets of many different diameters. Of course, where the positional members 50 are adjustable on themselves, the corresponding secondary support members 40 would also be configurable to be adjustable on themselves.

Embodiments of the apparatus 10 may further comprise a primary scraper 60. The primary scraper 60 may be a material having a length defined between a first end 62 and a second end 64. The length of the primary scraper 60 may be fixed. The length of the primary scraper 60 may be adjustable. The length of the primary scraper 60 may be adjustable on itself. In other words, the primary scraper 60 may be comprised of one or more parts that are adjustable with respect to one another to adjust the overall length of the primary scraper 60. The primary scraper 60 may be comprised of rigid materials, such as rigid polymers, plastics, metals, and other like materials that may provide the structure and function of the positional member 50 herein described. The primary scraper 60 may alternatively be comprised of semi-rigid materials that allow the primary scraper 60 to bend and flex from an original position to a flexed position in response to a force input or a force exerted on the primary scraper 60. The primary scraper 60 may then return to the original position after the force input or application of force has been removed. The primary scraper 60 may be comprised of rubber or other food-grade quality materials. The primary scraper 60 may be biased toward the original position. The primary scraper 60 may engage interior surfaces of a bucket placed over a primary support member 30 or a set of primary support members 30, the interior surfaces of the bucket including interior side surfaces and interior bottom surfaces. The apparatus 10 may comprise secondary scrapers 61 that have the same form and functionality as described with regard to the primary scraper 60.

Embodiments of the apparatus 10 may further comprise the primary scraper(s) 60 being coupled to one or more of the primary support members 30 and/or the secondary scraper(s) 61 coupled to one or more secondary support members 40. The scrapers 60 and 61 may comprise a hole 66 therein at a position along the length of the scrapers 60 and 61. The scrapers 60 and 61 may have one or more holes 66 therein at specified positions along the length of the scrapers 60 and 61. The holes 66 in the scrapers 60 and 61 may communicate with corresponding openings 36 in the primary support member 30 and with corresponding openings 46 in the secondary support member 40. A fastener 70 may be inserted within each of the holes 66 and the corresponding openings 36 or 46 to couple the scrapers 60 and 61 to the primary support member 30 or the secondary support member 40, respectively. The scrapers 60 and 61 may comprise an engagement edge 68 and 69 respectively that extends beyond the edge 38 of the primary support member 30 or the edge 48 of the secondary support member 40, respectively. In this way, as the bucket is inserted over the primary support members 30, the primary scrapers 60 placed thereon may engage the interior surfaces of the bucket, whereas the secondary scrapers 61 coupled on the secondary support member 40 may engage the interior bottom surface of the bucket. As described above, the scrapers 60 and 61 may be adjustable with respect to each of the primary support members 30 and secondary support members 40 upon which a corresponding scrapers 60 and 61 is placed/coupled.

Embodiments of the apparatus 10 may further comprise the fastener 70 being comprised of nuts and bolts, rivets, threaded fasteners, press fit fasteners, hook and loop fasteners (Velcro®), snaps, adhesives, straps, ties, pins, pegs, nails, latches, retaining rings, buttons, clamps, cable ties, clasps, grommets, zippers, and other like fasteners. The fasteners 70 may comprise one or more of the above-listed types of fastening means. The fasteners 70 may permit each of the scrapers 60 to be releasably and repeatedly coupled to the primary support members 30 and secondary support members 40 upon which a corresponding scraper 60 is desired to be placed/coupled.

Figure 4:
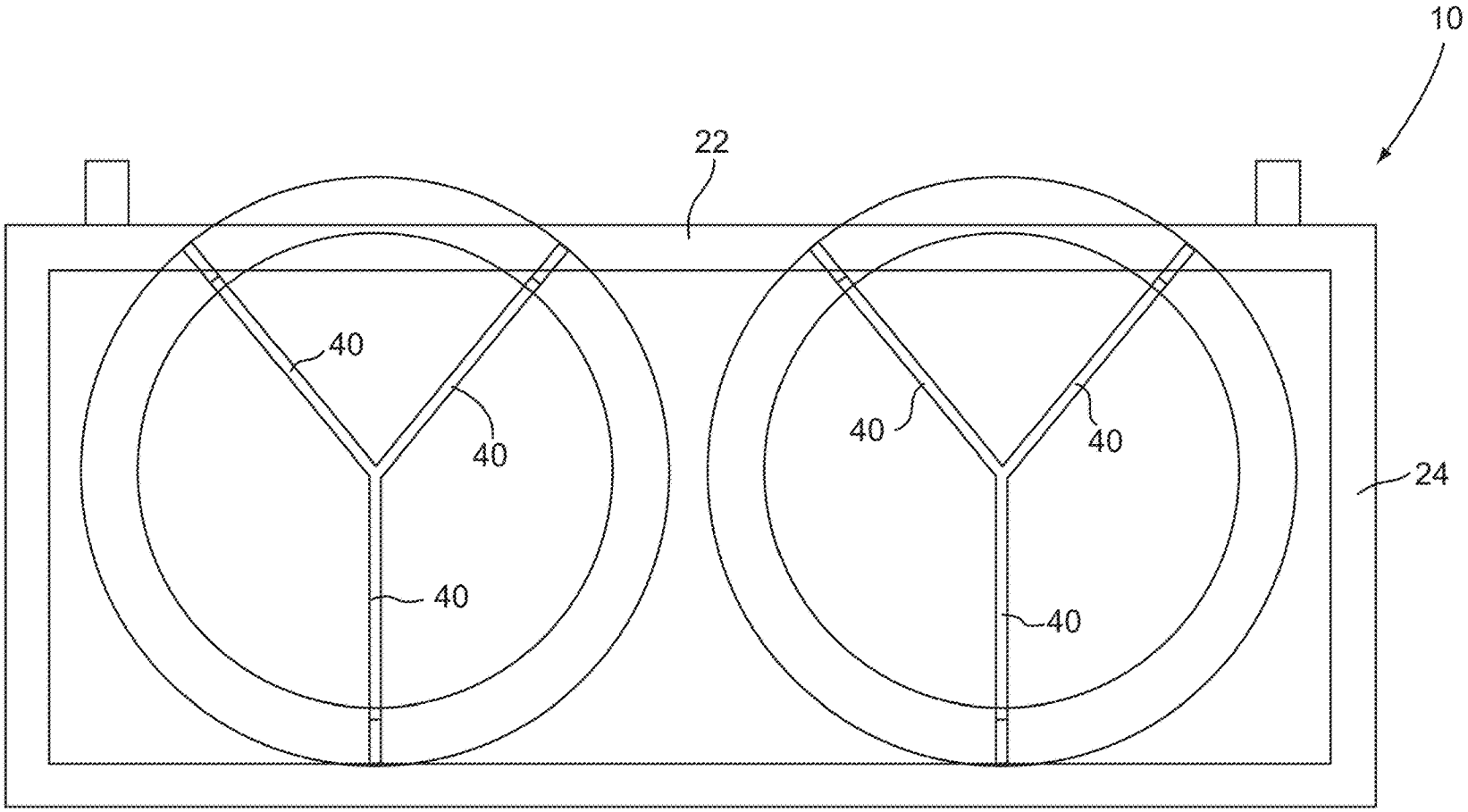
FIG. 4 is a top view of an embodiment of a bucket cleaning apparatus in accordance with the present disclosure.
Figure 5:
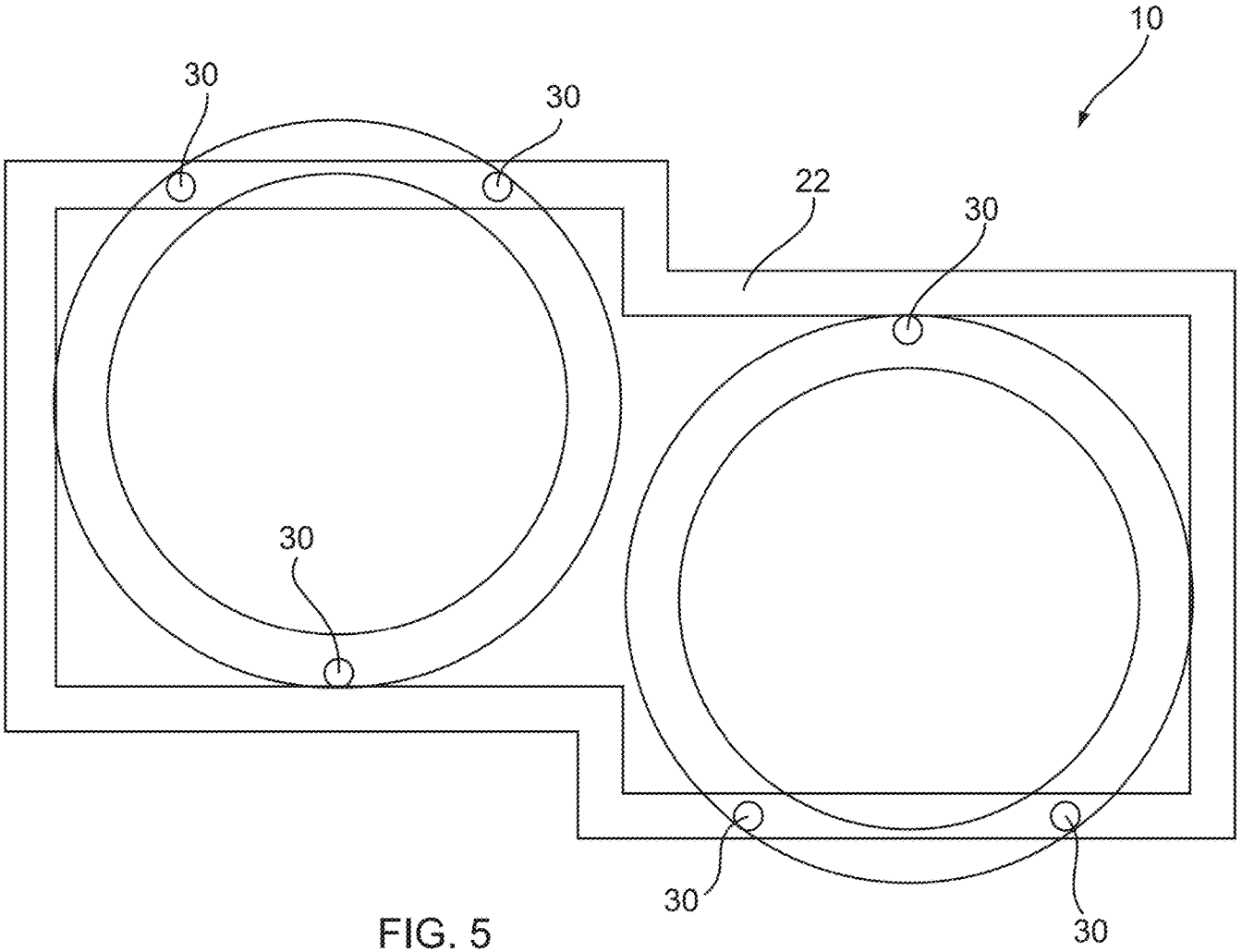
FIG. 5 is a top view of an embodiment of a bucket cleaning apparatus in accordance with the present disclosure.

As depicted in the Figures, embodiments of the apparatus 10 may further comprise a plurality of sets of primary support members 30 being coupled on the frame 20. The plurality of sets of primary support members 30 may have the same size configuration so as to engage buckets of the same diameter, as depicted in FIG. 4. In the alternative, the plurality of sets of primary support members 30 may have different sizes so as to engage buckets of different sizes and various diameters, as depicted in FIGS. 1, 2A, 2B and 3. Furthermore, the plurality of sets of primary support members 30 may be offset from one another to reduce the size of the frame 20 or to advantageously position each of the sets of primary support members 30 with respect to other sets on the same frame 20, as depicted in FIG. 5.

Figure 6:
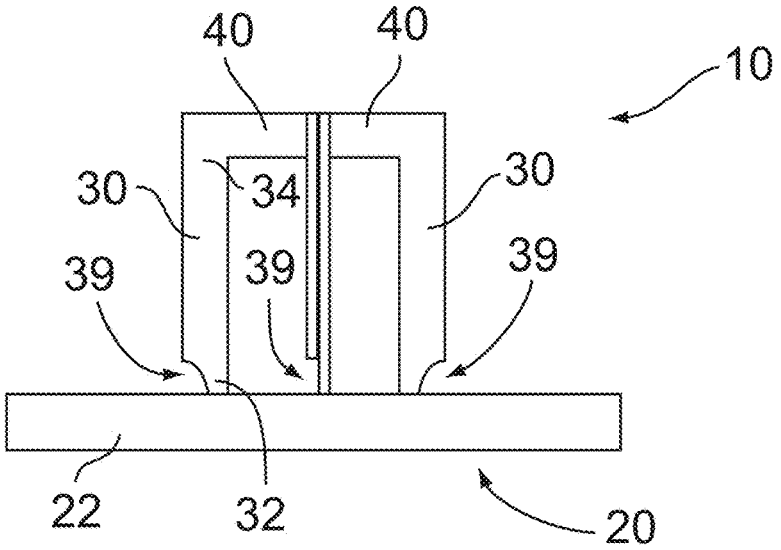
FIG. 6 is a side view of an embodiment of a bucket cleaning apparatus in accordance with the present disclosure.

As depicted in FIG. 6, embodiments of the apparatus 10 may further comprise an indentation 39 in the primary support members 30 at a lower end of the primary support member 30 near the first end 32. The indentation 39 may be a relief-cut-out that can function to receive a top lip of a bucket and permit the bucket with a top lip to be engaged by the primary scrapers 60 on each of the primary support members 30. Some buckets have a top lip that protrudes into the interior diameter of the bucket, such as a one-gallon paint can. However, in embodiments of the apparatus 10 having the indentation 39, when the bucket having the interior top lip is placed onto (over) the primary support members 30, the primary support members 30 may flex or elastically bend to permit the bucket to be placed completely over the primary support members 30, or at least enough over the primary support members 30 for the lip to enter into the indentation 39 and allow the primary support members 30 to more completely engage the interior surfaces of the bucket to clean the interior side and bottom surfaces of the bucket.

Alternatively, embodiments of the apparatus 10 may include the primary scrapers 60 being placed onto the primary support members 30 having the indentation 39 therein. Under this condition, the primary scrapers 60 may flex in response to the top lip engaging the primary scrapers 60 as the bucket is slipped over the primary support members 30. But, as soon as the top lip enters the indentation 39, the scrapers 60 may flex back toward their original form and engage the interior surfaces of the bucket to clean the side and bottom surfaces of the bucket.

Embodiments of the apparatus 10 may further comprise the primary support members 30, the secondary support members 40 and the positional supports 50 being manufactured of as a single uniform component and thereafter coupled to the frame 20. This uniform component may be coupled to the frame by fastening means, such as snaps, buttons, nuts and bolts, rivets, threaded fasteners, press fit fasteners, hook and loop fasteners (Velcro®), adhesives, straps, ties, pins, pegs, nails, latches, retaining rings, clamps, cable ties, clasps, grommets, zippers, and other like fasteners. In alternative embodiments, the primary support members 30, the secondary support members 40, the positional supports 50, and the frame 20 may be manufactured as a single uniform component. In alternative embodiments, the primary support members 30, the secondary support members 40, the positional supports 50, and the frame 20 may each be manufactured as separate components and thereafter assembled, as herein described and depicted.

Figure 7A:
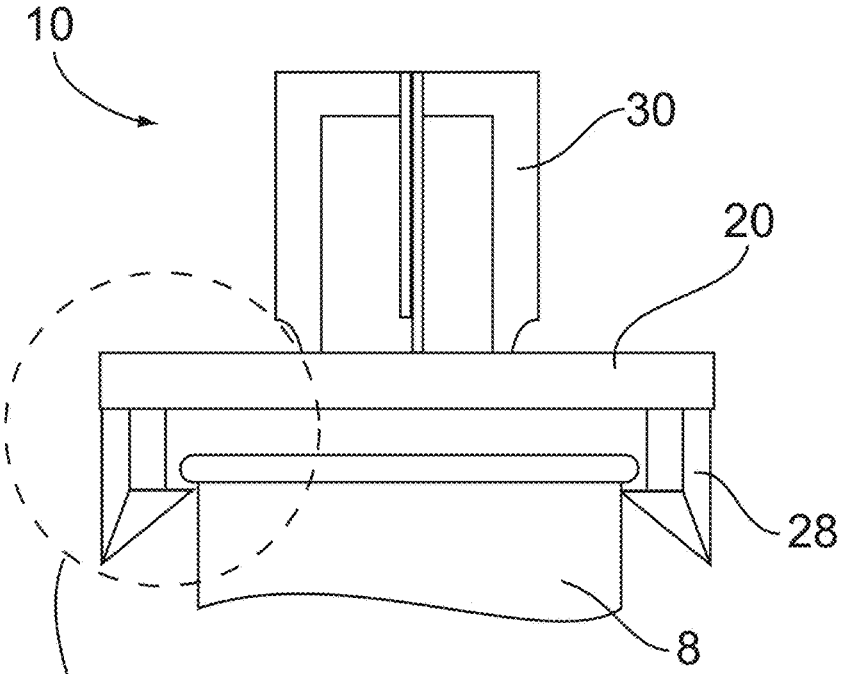
FIG. 7A is a side view of an embodiment of a bucket cleaning apparatus in accordance with the present disclosure.
Figure 7B:
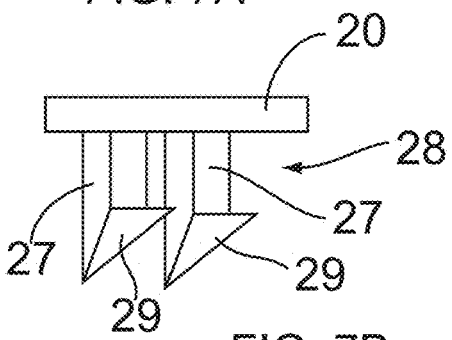
FIG. 7B is a zoomed-in perspective view of a component of the embodiment of the bucket cleaning apparatus depicted in cut-out A in FIG. 7A, in accordance with the present disclosure.
Figure 8A:
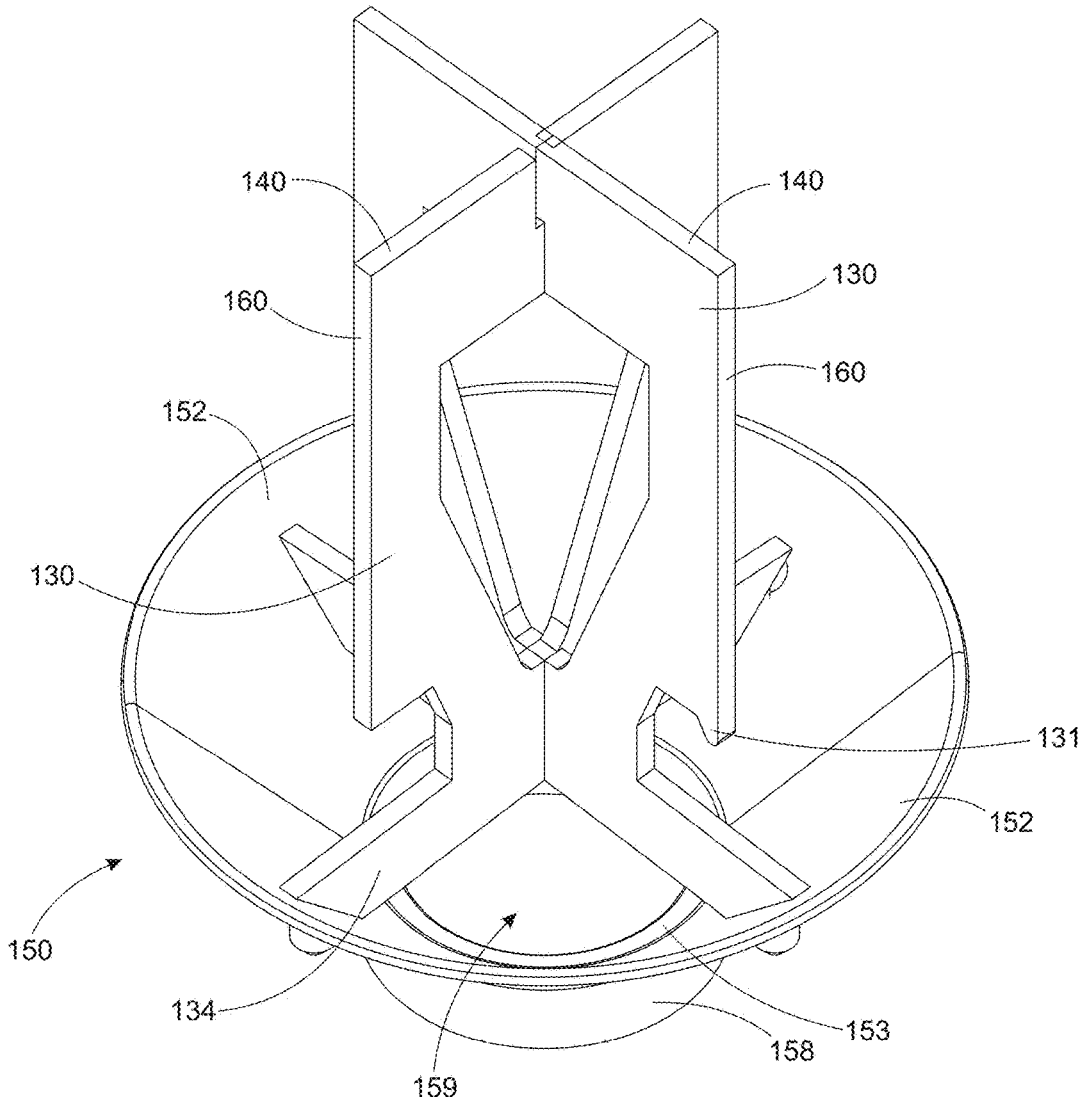
FIG. 8A is a bottom perspective view of a bucket cleaning apparatus with a funnel.
Figure 8B:
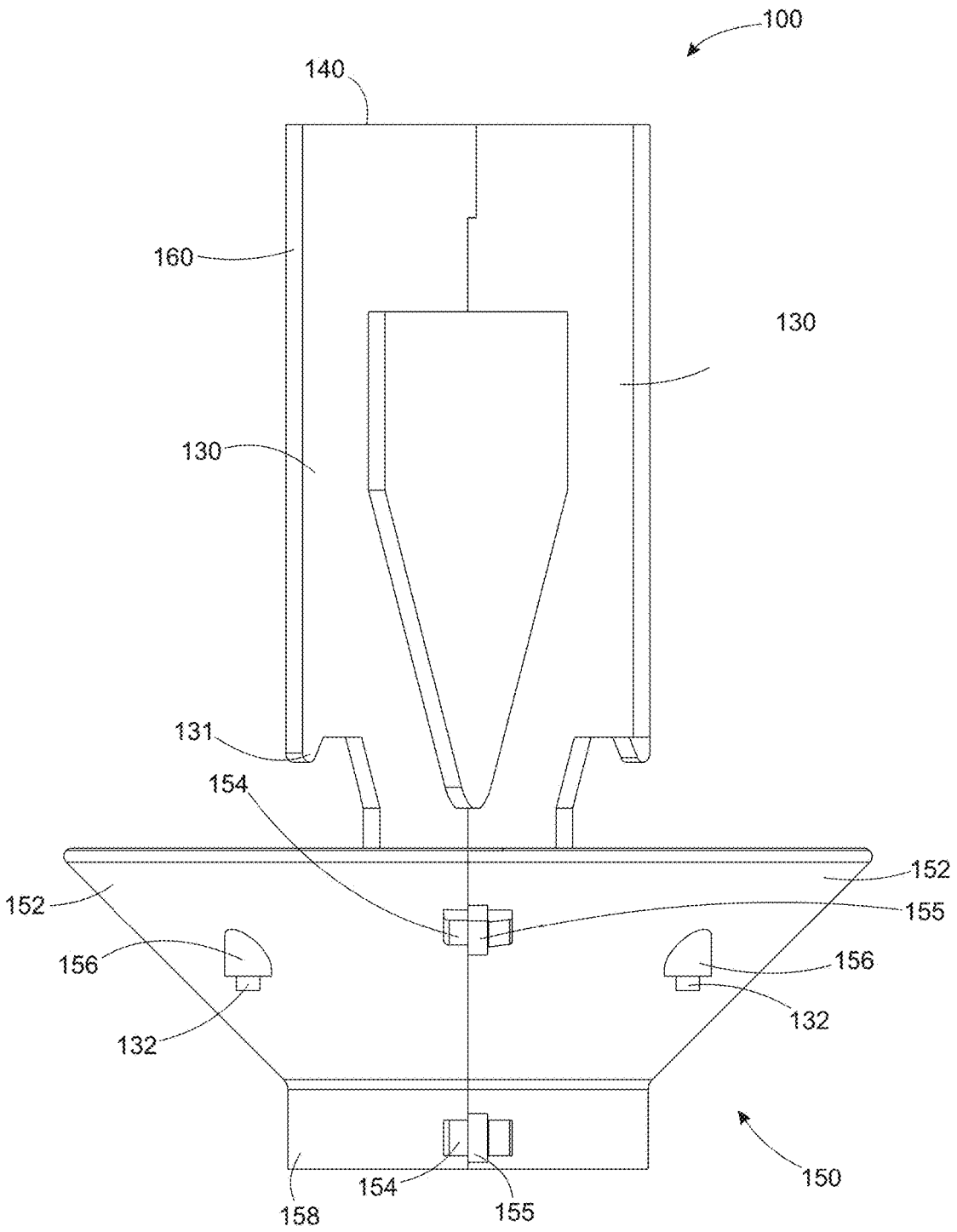
FIG. 8B is a front view of a bucket cleaning apparatus with a funnel.
Figure 8C:
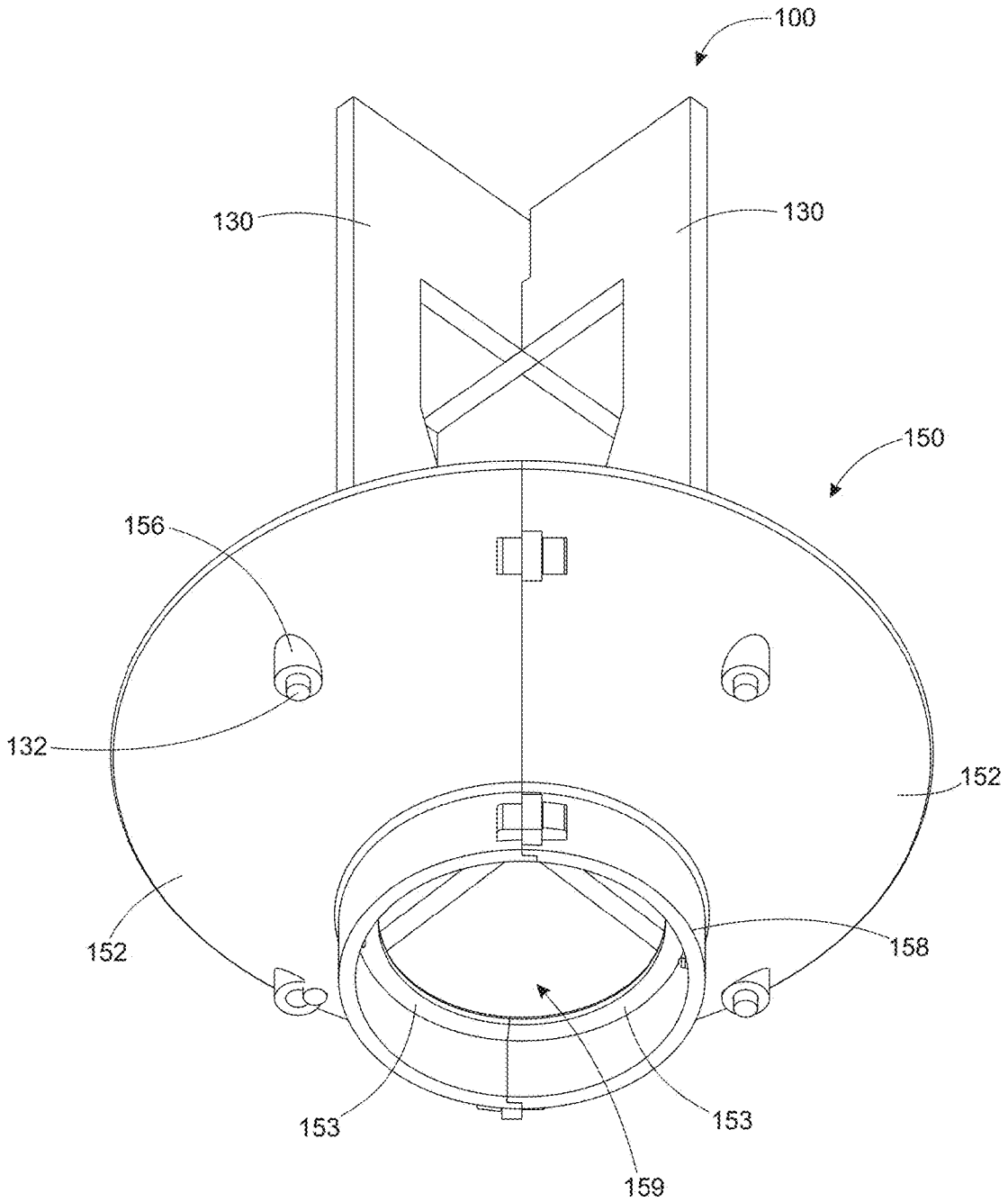
FIG. 8C is a top perspective view of a bucket cleaning apparatus with a funnel.
Figure 8D:
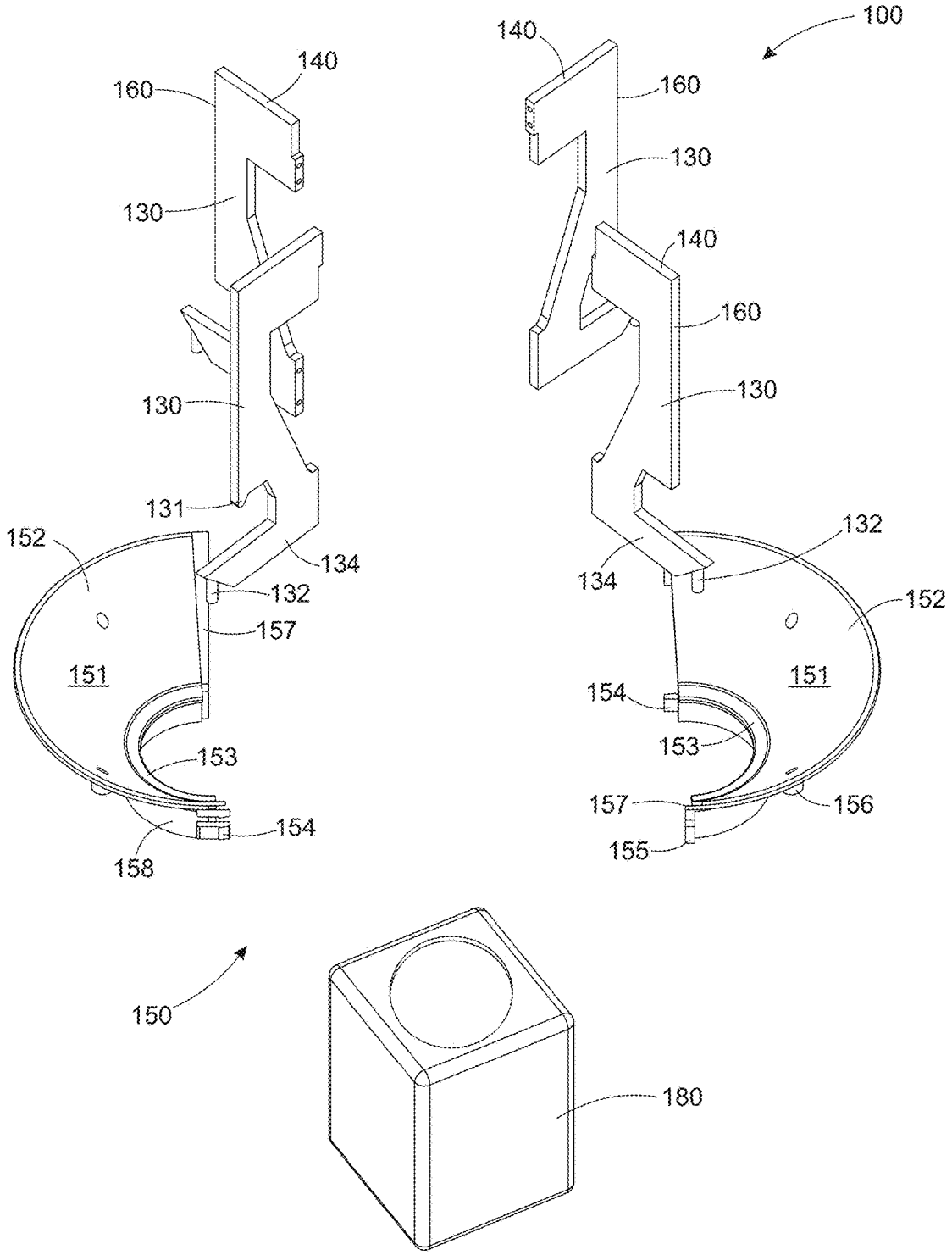
FIG. 8D is an exploded perspective view of a bucket cleaning apparatus with a funnel and a container for coupling to the bucket cleaning apparatus.

As depicted in FIG. 7, embodiments of the apparatus 10 may further comprise the adjustable couplers 28 being resilient clamps 27 that are located on portions of the frame members 22. The resilient clamps 27 may have a grasping member 29 thereon that may flex from an original position to a flexed position in response to force. Each of the grasping members 29 may further grip and retain a portion of the object 8 on which the frame 20 has been placed, such as a plastic five-gallon bucket. For example, each of the grasping members 29 may flex over an exterior feature, such as a lip, of the plastic five-gallon bucket and thereafter engage the exterior feature of the plastic five-gallon plastic bucket to retain the apparatus 10 thereon such that the apparatus 10 may be positioned on and above the plastic five-gallon bucket. Embodiments of the apparatus 10 may further comprise the resilient clamps 27 and the frame 20 being manufactured as a single uniform component. Alternative embodiments of the apparatus 10 may further comprise the resilient clamps 27 and the frame 20 being manufactured as separate components and thereafter assembled together.

Referring again to the drawings, FIGS. 8A-8D depict a bucket cleaning apparatus 100 comprising a plurality of support members 130 with a primary scraper 160 formed on an edge of each support member 130. In some of the support members 130 may include a protrusion 131. The apparatus 100 may also include a plurality of secondary support scrapers 140 formed on a top edge of the support member 130. The support members 130 are coupled to a funnel 150. The components that form the apparatus 100 may be assembled for use and then disassembled for cleaning and storage.

In embodiments, there may be four support members 130 coupled together to form a plus sign configuration wherein each support member 130 is substantially perpendicular to the adjacent support members 130 when viewed from a top view. The support members 130 further include a base portion 134 having a funnel coupling member 132 that couples to the funnel 150. In embodiments, the funnel coupling member 132 is a rod or threaded rod that engages a support member aperture 156 formed through the inner surface of a tapered portion 151 of the funnel 150. A coupling device, such as a clamp or a nut may be used to couple the funnel coupling member 132 to the funnel as it extends through the support member aperture 156 of the funnel 150. In embodiments, two of the support members 130 may be formed as a unitary piece and the other two support members 130 may be formed as a unitary piece, wherein each pair of the support members 130 are in the same plane. In this embodiment, there may be slots to allow the pairs of support members 130 to be coupled together in the plus configuration as described above.

The funnel 150 may be formed of two funnel members 152. Each funnel member includes a tapered portion 151, a lip 153, coupling protrusions 154, coupling receivers 155, a support member aperture 156, an extension member 157, and a vertical portion 158. The two funnel members 152 may be coupled together to form a full funnel that is a frustro-conical in shape with an aperture 159 extending through the funnel 150. The two funnel members 152 may coupled together by use of the coupling protrusions 154 engaging coupling receivers 155 like a buckle or clip. The extension member 157 operates to overlap an edge of the other funnel member 152 to act as a seal to prevent paint or other material being emptied from a bucket to leak. The tapered portions 151 form an opening wider that the support members 130 coupled together in the plus configuration and taper to the lip 153 and vertical portion 158, the vertical portion 158 is configured to couple to a container 180. The lip 153 may be located at the junction of the tapered portion 151 and the vertical portion 158. The lip 153 prevents paint or other contents from a bucket (not shown) from over flowing over the edge of the container. The vertical portion 158 may include internal threads that engage external threads of the container to form a threaded coupling between the vertical portions 158 and the container 180. The support member aperture operates to receive a funnel coupling member 132 as described above.

In operation, the support members 130 coupled to the funnel 150 form the bucket cleaning apparatus 100. The funnel 150 is coupled to the container 180. The support members 130 are placed within a bucket and the bucket is oriented with the opening facing down to empty the contents of the bucket, such as paint. This allows material from within the bucket to fall within the funnel 150 and empty into the container 180. The primary scrapers 160 and the secondary scrapers 140 operate to scrape material from the inner sides and inner bottom side of the bucket and empty the material through the funnel 150 and into the container 180. The protrusions 131 operate to scrape material gathering on a lip of the bucket, such as a paint buck (can), and empty the material through the funnel 150 and into the container 180. Once the bucket is scraped out and emptied, the funnel 150 may be uncoupled from the container 180 and a lid coupled to the open end of the container 180. The bucket can then be disposed of. The apparatus 100 may easily be disassembled for easy cleaning and storage. This particular apparatus 100 is particularly useful for one-gallon buckets, such as paint buckets.

While the funnel 150 is shown as two funnel members 152, it will be understood that the funnel 150 may be a single member forming the funnel 150 with a tapered portion 151, a lip 153 and a vertical portion 158, wherein the plurality of support members 130 may be coupled to the funnel 150. The funnel 150 may be a frustro-conical in shape with an aperture 159 extending through the funnel 150. The tapered portion 151 form an opening wider that the support members 130 coupled together in the plus configuration and taper to the lip 153 and vertical portion 158. The vertical portion 158 is configured to couple to a container 180. The lip 153 may be located at the junction of the tapered portion 151 and the vertical portion 158. The lip 153 prevents paint or other contents from a bucket (not shown) from over flowing over the edge of the container 180. The vertical portion 158 may include internal threads that engage external threads of the container to form a threaded coupling between the vertical portions 158 and the container 180. The support member aperture operates to receive a funnel coupling member 132 as described above.

Figure 9A:
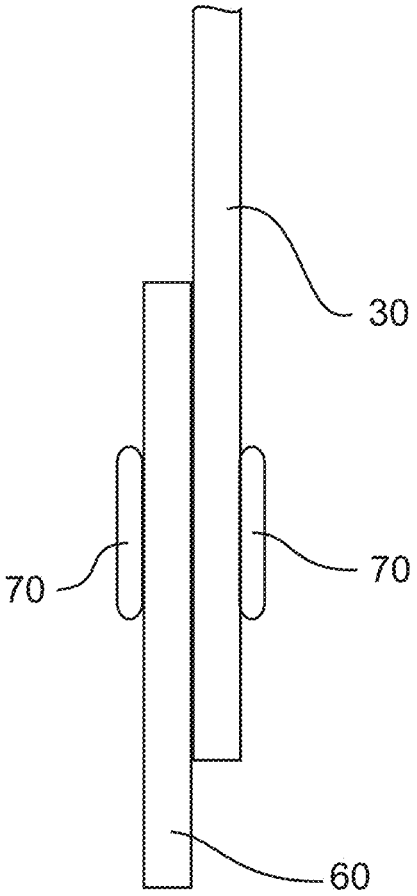
FIG. 9A is a top view of a portion of a primary support with a primary scraper.
Figure 9B:
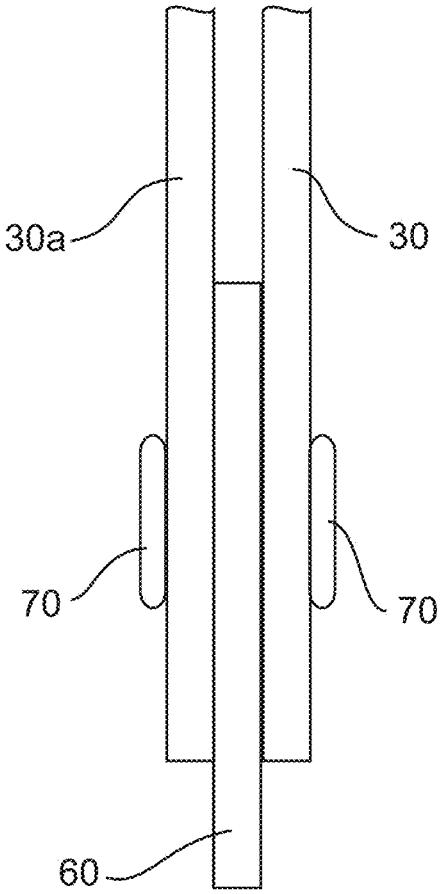
FIG. 9B is a top view of another primary support with a primary scraper.

Referring to FIGS. 9A and 9B, a top portion view of a primary support member 130 is shown. The primary support member 13 is coupled to a primary scraper 60 by use of fastening device 17. In other embodiments include a primary support member having a first portion 30 and a second portion 30*a*. The primary scraper 60 may be coupled between the first portion 30 and the second portion 30*a* to sandwich the primary spacer 60 between the two support members 30 and 30*a*. A fastener 70 is used to secure the primary spacer 60 to the primary support member. It should be appreciated that at fastener 70 is removeable and allows a new primary spacer 60 to be coupled to the apparatus after removing the worn primary scraper 60. The same is true for the secondary spacer 61 coupled to a secondary support member 40.

Figure 10:
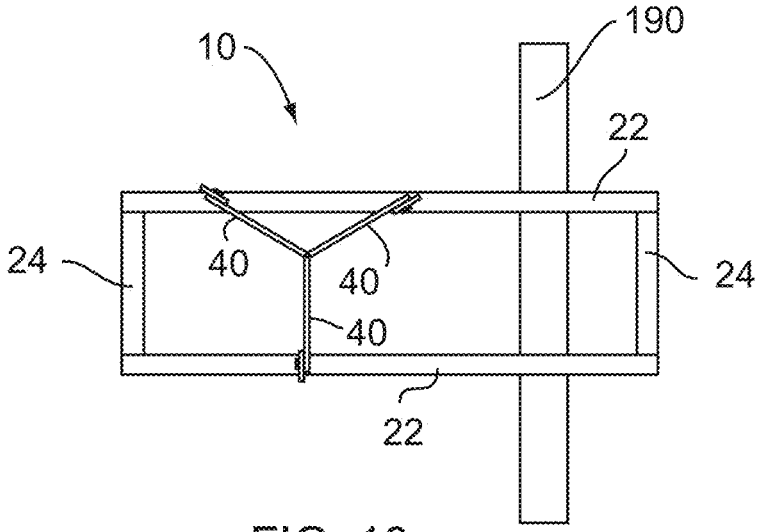
FIG. 10 is a top view of an embodiment of a bucket cleaning apparatus with an elongate member.
Figure 11:
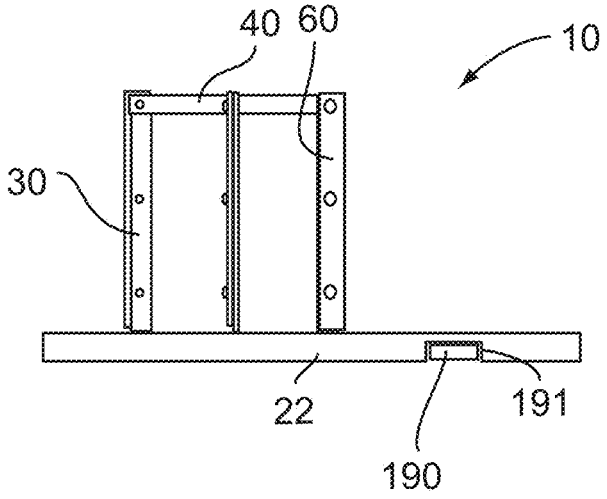
FIG. 11 is a side view of an embodiment of a bucket cleaning apparatus with an elongate member.

As show in FIGS. 10 and 11, a bucket cleaning apparatus 10 is depicted. Embodiments of the apparatus 10 may comprise, among other components, a frame 20, a primary support member 30, a secondary support member 40, a positioning member 50, and a primary scraper 60 and a secondary scraper 61.

The frame 20 may comprise a frame member 22. The frame member 22 may be any structure, component, part, or piece that may support the additional components of the apparatus 10 thereon. The frame member 22 may assume any shape and size that is convenient to set thereon the additional components of the apparatus 10. As depicted, the frame 20 may comprise one or more frame members 22, and these frame members 22 may be oriented with respect to one another substantially in parallel and oppose one another along their respective lengths. The frame 20 may comprise secondary frame members 24 that may be in an orientation that is substantially orthogonal to the frame members 22, such that under the condition the secondary frame members 24 are coupled to the distal ends of each of the frame members 22, the length of the secondary frame members 24 spaces apart the frame members 22 from one another. As depicted, the configuration of the frame members 22 and the secondary frame members 24 comprise a rectangular, or box-like, frame, with the frame members 22 and the secondary frame members 24 coupled thereto at respective distal ends. As depicted, the frame members 22 may be fixedly coupled to the secondary frame members 24 to form a box-like shape for the frame 20.

Moreover, the frame members 22 may comprise brackets 191. These brackets 191 may allow an elongate member to extend there through. The elongate member 190 may be substantially coplanar with a bottom of the frame 20, wherein the elongate member 190 supports a user who stands on the elongate member 190 to prevent the frame from rotating when scraping bucket content onto a surface. The surface may be a roof or a driveway or any other surface that may receive a coating from material that is provides in buckets. This allows the user to use most, if not all material within the bucket.

In addition to that described above, embodiments of the apparatus 10 may comprise the component parts being formed of any of many different types of materials or combinations thereof that can readily be formed into shaped objects provided that the components selected are consistent with the intended operation of a bucket cleaner of the type disclosed herein. For example, and not limited thereto, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof. Embodiments of the apparatus 10 may comprise the primary support members 30, the secondary support members 40, the positional supports 50, and the frame 20 being manufactured of carbon steel, stainless steel, stainless aluminum, plastic, or other like materials. Intended use of the apparatus 10 may direct what type of material comprises the component parts of the apparatus 10.

Figure 12:
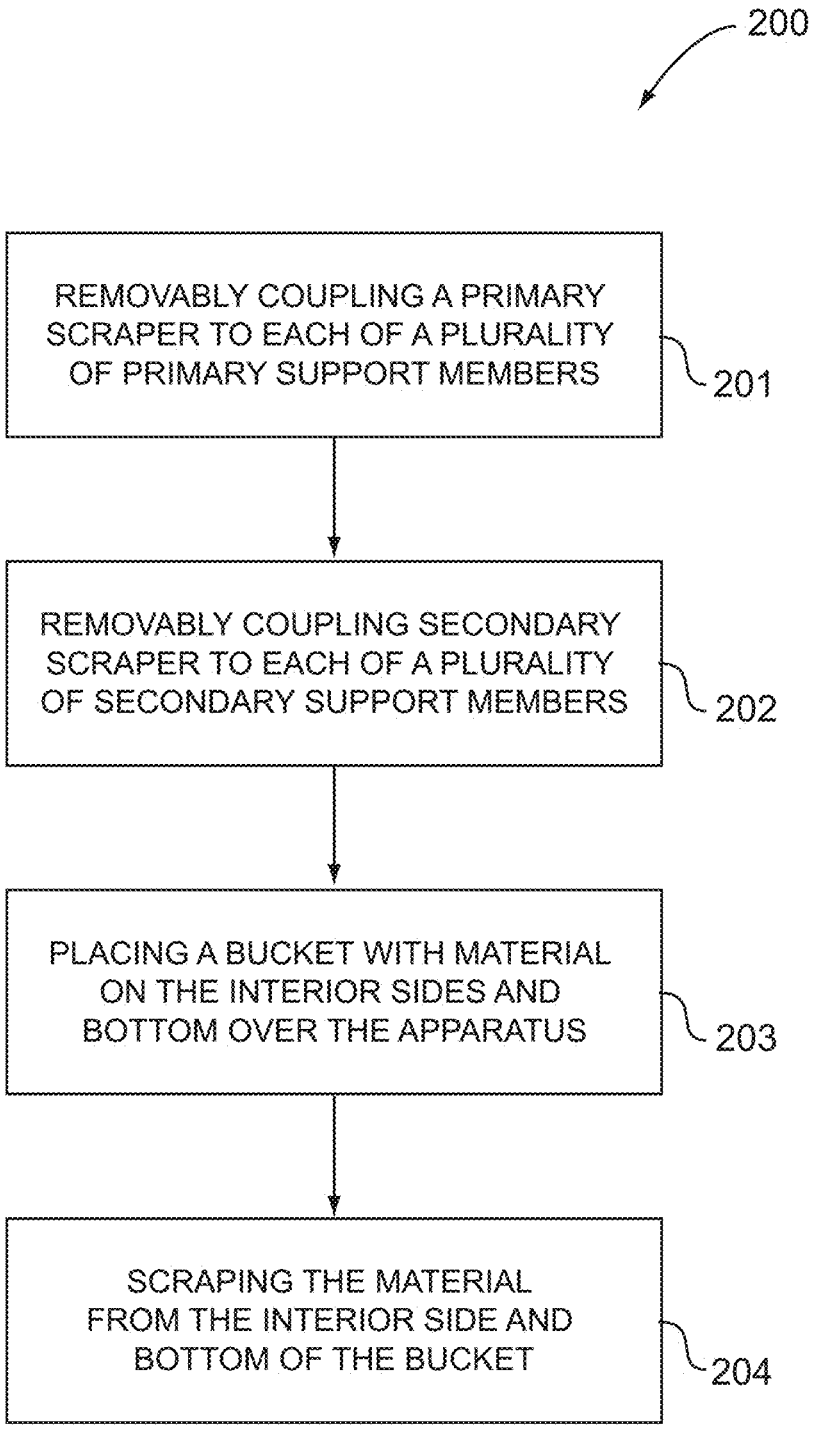
FIG. 12 is a flow chart of a method of using a bucket cleaning apparatus.

Some embodiments include a method 200 of using a bucket cleaning apparatus as shown in FIG. 12. The method 200 comprises removably coupling a primary scraper to each of a plurality of primary support members coupled individually to a frame (Step 201); removably coupling secondary scraper to each of a plurality of secondary support members, each secondary support member being coupled to a corresponding primary support member of the plurality of primary support members (Step 202); placing a bucket with material on the interior sides and bottom over the apparatus wherein the primary scrapers engage the interior sides and the secondary scrapers engage the interior bottom of the bucket (Step 203); and scraping the material from the interior side and bottom of the bucket in response to rotating the bucket while over the apparatus (Step 204).

The method 200 may also comprise emptying the scraped material out of an opening of the bucket and into another container; and replacing the primary scrapers and the secondary scrapers when they are worn. In order to replace the scrapers, replacement scrapers may be provided. Further the scrapers may have a flat end or a chamfered end.

Furthermore, the components defining the above-described apparatus 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A bucket cleaning apparatus, the apparatus comprising:

four support members, each support member having a primary scraper formed on a side edge, a second scraper formed on a top edge and a base portion, wherein the four support members are coupled together to form a plus sign configuration when viewed from a top view, wherein at least one support member comprises a protrusion extending downward from a bottom of the primary scraper edge, and wherein the protrusion is configured to scrape material from a lip of a bucket, said lip protruding into an interior diameter of said bucket; and a funnel having a tapered portion and a vertical portion coupled together to form the funnel with an aperture extending through the funnel, wherein the four support members are coupled to the funnel such that the base portions engage and are coupled to a surface of the tapered portion.

2. The apparatus of claim 1, wherein the funnel includes a lip, the funnel lip operating to prevent material emptied from a bucket to flow over and edge of a container receiving the emptying material from the bucket.

3. The apparatus of claim 2, wherein the vertical portion of the funnel is coupled to the container, and wherein the tapered portion directs material being emptied from the bucket into the container.

4. A bucket cleaning apparatus, the apparatus comprising:

four support members, each support member having a primary scraper formed on a side edge, a secondary scraper formed on a top edge and a base portion, wherein the four support members are coupled together to form a plus sign configuration when viewed from a top view, wherein at least one support member comprises a protrusion extending downward from a bottom of the primary scraper edge, and wherein the protrusion is configured to scrape material from a lip of a bucket, said lip protruding into an interior diameter of said bucket; and a funnel having a tapered portion and a vertical portion coupled together to form the funnel with an aperture extending through the funnel and a lip located at a junction of the tapered portion and the vertical portion, wherein the four support members are coupled to the funnel such that the base portions engage and are coupled to a surface of the tapered portion, and wherein the lip located at the junction is configured to prevent material emptied from a bucket from flowing over an edge of a container receiving the emptying material from the bucket.

5. The apparatus of claim 4, wherein the vertical portion of the funnel is coupled to the container, and wherein the tapered portion directs material being emptied from the bucket into the container.

6. The apparatus of claim 5, wherein the vertical portion of the funnel includes threads to couple to the container.

* * * * *